US011805828B2

(12) United States Patent
Adkins et al.

(10) Patent No.: US 11,805,828 B2
(45) Date of Patent: Nov. 7, 2023

(54) MASK WITH ANTI-FOGGING CONSTRUCTION

(71) Applicant: AETHER MASK, LLC, Park City, UT (US)

(72) Inventors: Michael Adkins, Fruit Heights City, UT (US); Philip A. Davidson, Park City, UT (US); Mykell Johnson, Logan, UT (US); Spencer Peterson, Salt Lake City, UT (US)

(73) Assignee: AETHER MASK, LLC, Park City, UT (US)

( * ) Notice: Subject to any disclaimer, the term of this patent is extended or adjusted under 35 U.S.C. 154(b) by 0 days.

(21) Appl. No.: 17/698,997

(22) Filed: Mar. 18, 2022

(65) Prior Publication Data

US 2022/0295922 A1 Sep. 22, 2022

Related U.S. Application Data

(60) Provisional application No. 63/163,665, filed on Mar. 19, 2021.

(51) Int. Cl.
*A41D 13/11* (2006.01)

(52) U.S. Cl.
CPC ..... *A41D 13/1176* (2013.01)

(58) Field of Classification Search
CPC . A41D 13/11–1192; A62B 7/12; A62B 17/00; A62B 17/006; A62B 18/00; A62B 23/00–025; A61M 16/06–0655; A61M 2016/0661
See application file for complete search history.

(56) References Cited

U.S. PATENT DOCUMENTS

| | | | |
|---|---|---|---|
| 3,888,246 | A | 6/1975 | Lauer |
| 3,974,829 | A | 8/1976 | Tate, Jr. |
| 4,037,593 | A | 7/1977 | Tate, Jr. |
| 4,635,628 | A | 1/1987 | Hubbard et al. |

(Continued)

FOREIGN PATENT DOCUMENTS

| | | |
|---|---|---|
| JP | 2009066382 | 4/2009 |
| KR | 20110008148 | 1/2011 |

OTHER PUBLICATIONS

U.S. Appl. No. 63/163,665, filed Mar. 19, 2021.

(Continued)

*Primary Examiner* — Rachel T Sippel
(74) *Attorney, Agent, or Firm* — Kilpatrick Townsend & Stockton LLP

(57) ABSTRACT

An anti-fogging face mask can include a main body, a formable seal, and baffles. The main body may include a panel sized for coverage of mouth and nostrils in a donned position of the face mask. The formable seal member may be disposed along an upper portion of the main body and arranged for obstructing vapor flow from the mouth or nostrils to eyewear when the eyewear is positioned over the face mask in the donned position. A first baffle may be extending rearwardly and upwardly away from the formable seal. A second baffle may be positioned below the first baffle and extending rearwardly and upwardly away from the formable seal. A third baffle may be positioned below the second baffle and extending rearwardly and downwardly away from the formable seal.

17 Claims, 8 Drawing Sheets

(56) References Cited

U.S. PATENT DOCUMENTS

| | | | | |
|---|---|---|---|---|
| 4,802,473 | A | 2/1989 | Hubbard et al. | |
| 4,969,457 | A | 11/1990 | Hubbard et al. | |
| 5,020,533 | A | 6/1991 | Hubbard et al. | |
| 5,322,061 | A | 6/1994 | Brunson | |
| 5,383,450 | A | 1/1995 | Hubbard et al. | |
| 5,553,608 | A | 9/1996 | Reese et al. | |
| 5,813,398 | A | 9/1998 | Baird et al. | |
| 6,520,181 | B2 | 2/2003 | Baumann et al. | |
| 7,290,545 | B2 | 11/2007 | Kleman et al. | |
| 10,507,298 | B2 * | 12/2019 | Swenson | A61M 16/0816 |
| 11,134,730 | B1 * | 10/2021 | Paseman | A62B 9/04 |
| 2003/0217751 | A1 * | 11/2003 | Patrick | A62B 18/084 128/205.27 |
| 2012/0272973 | A1 * | 11/2012 | Palomo | A41D 13/1115 128/863 |
| 2013/0014760 | A1 * | 1/2013 | Matula, Jr. | A61M 16/0633 128/205.25 |
| 2019/0388636 | A1 * | 12/2019 | Steed, Jr. | A61M 16/0605 |
| 2020/0375281 | A1 * | 12/2020 | Prevot | A61F 9/029 |
| 2022/0023681 | A1 * | 1/2022 | Kim | A41D 13/1192 |
| 2022/0117331 | A1 * | 4/2022 | Hughes | A41D 13/1115 |

OTHER PUBLICATIONS

PCT Application No. PCT/US22/21038, filed Mar. 18, 2022.
"3M™ Aura™ Particulate Respirator 9205+, N95, 240 ea/Case", available at https://www.3m.com/3M/en_US/p/d/v101143932.
Application No. PCT/US2022/021038, International Search Report and Written Opinion, dated Jun. 28, 2022, 11 pages.

* cited by examiner

MASK WITH ANTI-FOGGING CONSTRUCTION

CROSS-REFERENCES TO RELATED APPLICATIONS

This application claims the benefit of U.S. Provisional Application No. 63/163,665, filed Mar. 19, 2021, the entire contents of which are hereby incorporated in their entirety for all purposes.

BACKGROUND OF THE INVENTION

Face masks are used to filter respiratory air and are used in many applications including healthcare, industry, and activities of everyday living. Face masks may be categorized in different groups (such as respirators, surgical masks, or barrier masks, to name a few), and different groups or types of face mask may be subject to differing regulatory requirements, such as FDA class 2 device approval or other criteria. Across different types, one common problem with the use of face masks is fogging of eyewear. Eyewear fogging can occur when warm moist exhaled air travels up along an interior of a face mask and contacts cooler surfaces of eyewear. The resulting condensate can then fog the lens of the eyewear and obstruct the wearer's ability to see clearly.

Many masks include a deformable wire that can be pressed into shape along the bridge of a wearer's nose. Such deformable wires are often included in an effort to help seal an upper part of the mask over the nose in an attempt to secure the mask and reduce the transmission of moist, exhaled air towards the eyeglasses. However, this solution does not prevent fogging in many instances because an effective seal is not created between the upper part of the mask and the face of the wearer. Attempts have been made to create a more effective seal by increasing the pressure of the mask against the face, placing foam strips at the upper mask part, and/or creating structures to divert the flow of exhaled air. None of these have been particularly effective at creating a cost-effective face mask that provides reliable anti-fogging performance.

BRIEF SUMMARY OF THE INVENTION

The following presents a simplified summary of some embodiments of the invention in order to provide a basic understanding of the invention. This summary is not an extensive overview of the invention. It is not intended to identify key/critical elements of the invention or to delineate the scope of the invention. Its sole purpose is to present some embodiments of the invention in a simplified form as a prelude to the more detailed description that is presented later.

In some embodiments, an anti-fogging face mask is provided. The face mask may include a main body that includes a panel sized to cover a mouth and nostrils of a wearer. The main body may have a front side facing in a forward direction extending away from the wearer in use. The main body may further define a rear side facing in a rearward direction extending toward the wearer in use. The mask can further include a formable seal member disposed along an upper portion of the main body. The formable seal may include a front face facing the main body. The formable seal may further include a rear face facing away from the main body. The formable seal can include a foam material shaped to include a tapered upper edge that tapers upwardly in a direction extending from the rear face toward the front face. The mask can further include a first pleat defining a first baffle extending upwardly and rearwardly from the rear face of the formable seal so as to define an eyewear-receiving channel between the first baffle and the tapered upper edge of the formable seal. The mask can further include a second pleat defining a second baffle extending upwardly from the rear face of the formable seal from a position below the first pleat. The mask can further include a third pleat defining a third baffle extending downwardly from the rear face of the formable seal from a position below the first pleat. The features of the mask may be arranged such that a lower channel is defined beneath the third pleat, a middle channel is defined between the third pleat and the second pleat, and an upper channel is defined between the second pleat and the first pleat. The first pleat, the second pleat, the third pleat, the first channel, the second channel, and the third channel may be configured for blocking or re-directing travel of exhaled vapor away from eyewear in the eyewear-receiving channel so as to mitigate against fogging of the eyewear in use.

In some embodiments, an anti-fogging face mask is provided. The face mask can include a main body comprising a panel sized for coverage of mouth and nostrils in a donned position of the face mask. The mask can further include a formable seal member disposed along an upper portion of the main body and arranged for obstructing vapor flow from the mouth or nostrils to eyewear when the eyewear is positioned over the face mask in the donned position. The mask can further include a first baffle extending rearwardly and upwardly away from the formable seal; a second baffle positioned below the first baffle and extending rearwardly and upwardly away from the formable seal; and a third baffle positioned below the second baffle and extending rearwardly and downwardly away from the formable seal.

In some embodiments, an anti-fogging assembly for a face mask is provided. The assembly can include a base comprising a formable seal member; a first baffle extending rearwardly from the base; a second baffle positioned below the first baffle and extending rearwardly from the base; a third baffle positioned below the second baffle and extending rearwardly from the base; and an attachment interface configured for facilitating attachment of the base with a main body of a face mask in a position for blocking upward vapor travel in a donned state.

For a fuller understanding of the nature and advantages of the present invention, reference should be made to the ensuing detailed description and accompanying drawings.

BRIEF DESCRIPTION OF THE DRAWINGS

Various embodiments in accordance with the present disclosure will be described with reference to the drawings, in which.

DETAILED DESCRIPTION OF THE INVENTION

Figure 1:
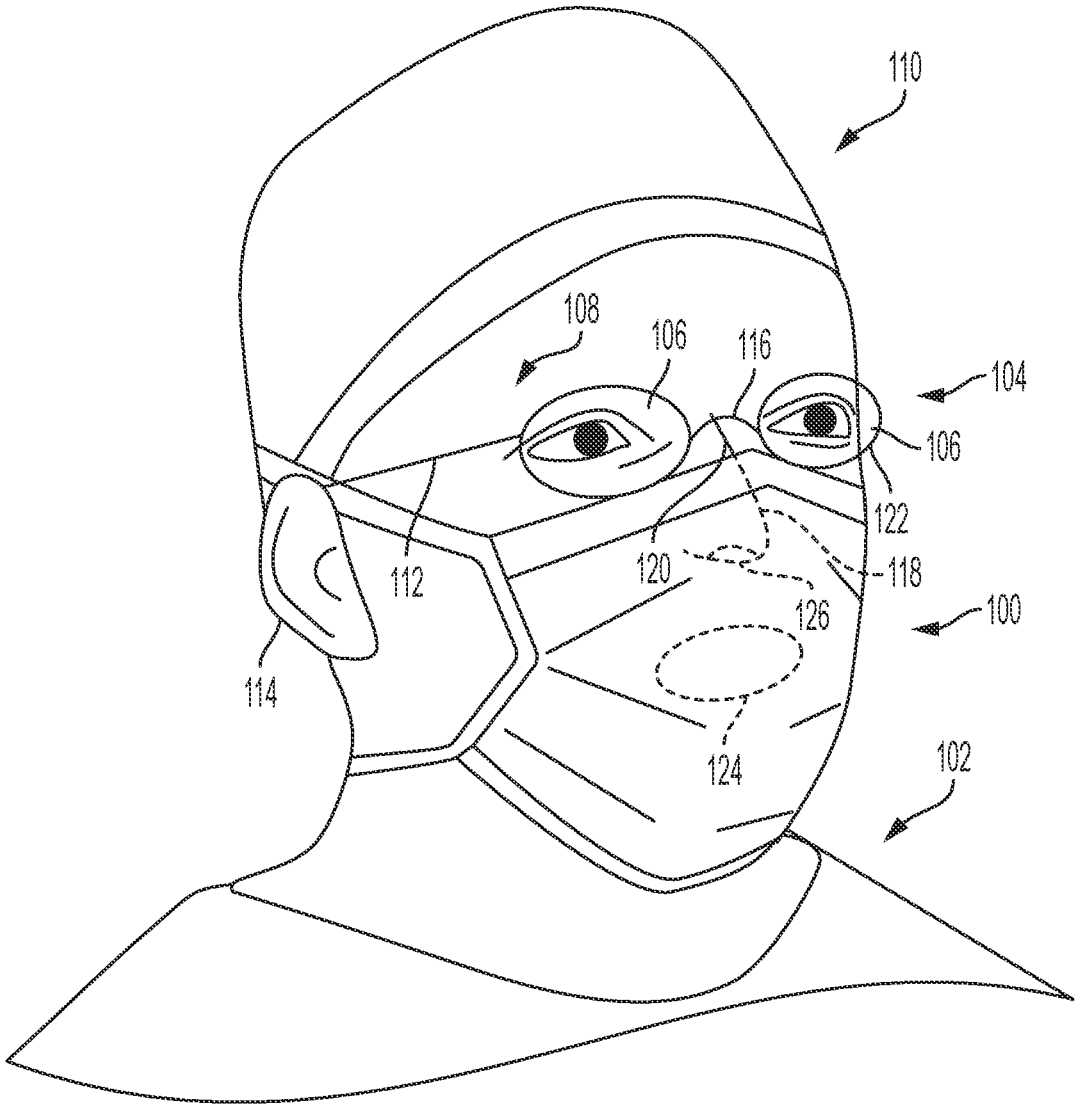
FIG. 1 depicts a perspective view of an example of a mask in a donned state, in accordance with various embodiments.

FIG. 1 depicts a perspective view of an example of a mask 100 in a donned state in accordance with various embodiments. The mask 100 can be a face mask. The mask 100 can be worn by a user 102. The wearer or user 102 may wear the mask 100 along with eyeglasses or other eyewear 104. The eyewear 104 may include lenses 106 or other surfaces that may be subject to fogging in certain conditions. The mask 100 may include features that may mitigate, reduce, and/or prevent fogging in use.

The eyewear 104 may include any suitable structure for supporting the eyewear 104 on a head 110 of the user 102. In various embodiments, the eyewear 104 includes a frame 108. For example, the frame 108 may include arms 112 that may rest against and/or extend over ears 114 of the user 102 in use. The frame 108 additionally or alternatively may include a nosepiece 116, which may support the eyewear 104 relative to a nose 118 of the user 102. For example, the nosepiece 116 may include a bar with suitable curvature to rest on the nose 118. The nosepiece 116 may additionally or alternatively include pads that can rest against the nose 118. In various embodiments, the nosepiece 116 may rest against a bridge 120 of the nose 118 to support the eyewear 104. In some embodiments, bottom-most or other portions of the lenses 106 (and/or portions of rims 122 that may be present about the lenses 106) may rest against the nose 118 or other portion of the head 110 of the user 102 to contribute to support of the eyewear 104.

Although one example of eyewear 104 is depicted in FIG. 1, the mask 100 may be utilized with any other suitable form of eyewear 104. Examples may include eyewear 104 that is suspended from above by a hat, visor, hood, band, or other structure and/or which is otherwise provided with omission of one or more of the arms 112 and/or any other support feature described above. The mask 100 may be utilized with a monocle, eyeglasses, or any other form of eyewear 104. Moreover, the mask 100 may be utilized with any form of lens 106. Examples may include prescription, magnifying, clear, colorized, polarized, sunglasses, compound (such as bi-focal, tri-focal, etc), single, or other forms of lenses.

In use, while wearing the mask 100, the user 102 may exhale or breathe out air that may exit by mouth 124 and/or nostril 126 (e.g., depicted in dashed lines in FIG. 1 as obscured from view by the mask 100). Generally, features of the mask 100 may protect against passage of exhaled air across the lenses 106 and thus may prevent fogging of the lenses 106 from exhaled air. Examples of various features of the mask 100 may be appreciated with reference to FIG. 2.

Physical Structure

Figure 2:
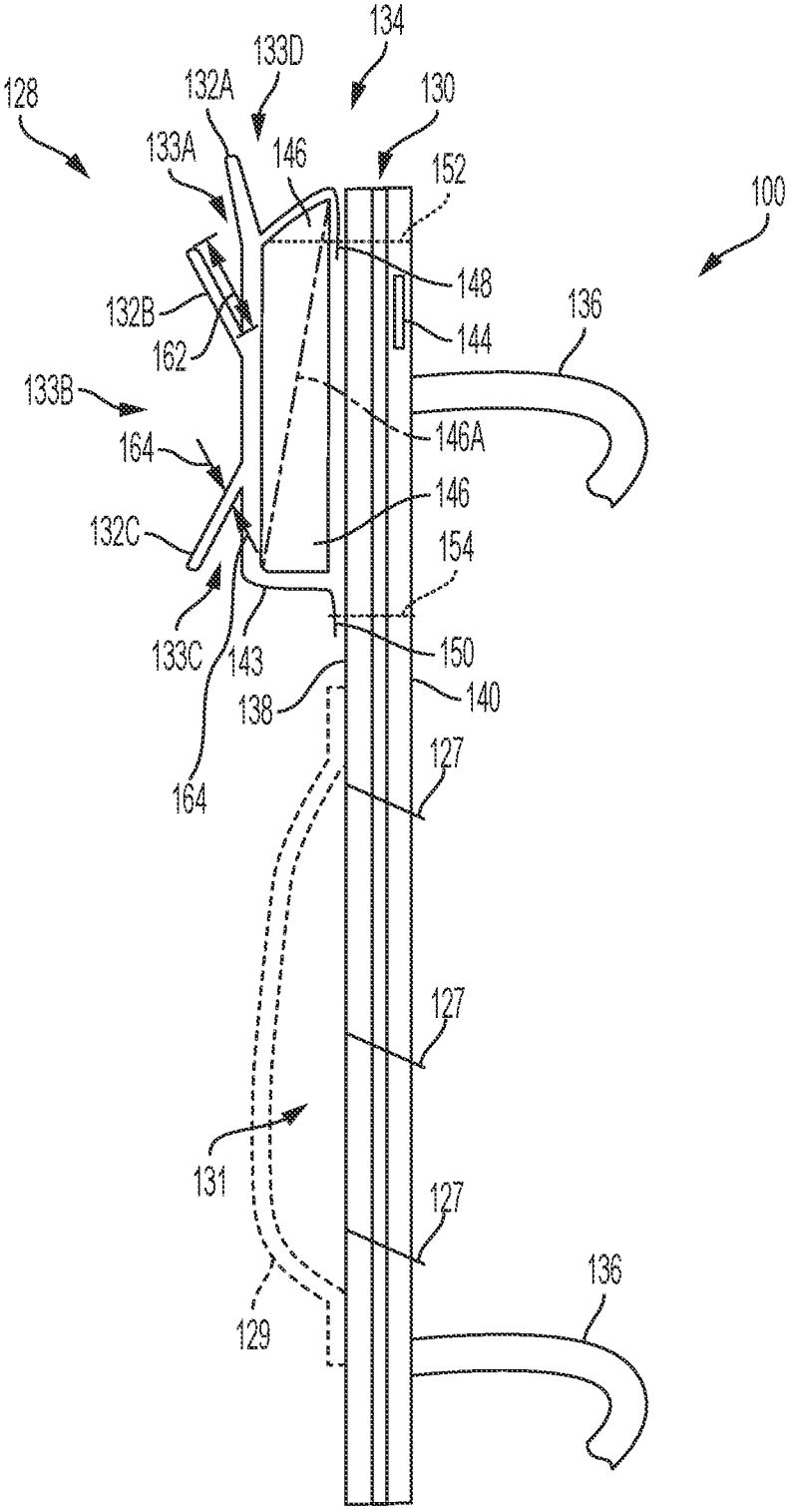
FIG. 2 depicts a side cross-sectional view of an example of the mask of FIG. 1, in accordance with various embodiments.

FIG. 2 depicts a side cross-sectional view of an example of the mask 100. The mask 100 may include or be coupled with an anti-fogging system 128. As depicted by way of example in FIG. 2, the mask 100 is shown with a main body 130, baffles 132 (e.g., individually identified as baffles 132A, 132B, and 132C), a formable seal 134, and straps 136, although other combinations of these and/or other features may be utilized. The baffles 132, formable seal 134, and/or other elements may form part of the anti-fogging system 128, for example.

Generally, the main body 130 may serve as a filter that extends over the mouth 124 and nose 118. The user 102 may adjust the mask 100 to fit their face by adjusting the restraining straps 136 and forming the formable seal 134 along an upper portion of the mask 100.

The main body 130 can serve as a filter. Additionally or alternatively, the main body 130 of the mask 100 may provide an attachment point for the straps 136 and/or other components and/or features of the mask 100. The main body 130 may include an inward face 138 and an outward face 140 that are arranged to respectively face toward and away from the face of the user 102 in use. For example, in use, the outward face 138 may correspond to a front side facing in a forward direction that extends away from the wearer 102 in use, and the inward face 138 may correspond to a rear side facing in a rearward direction extending toward the wearer in use.

The baffles 132 can be arranged along an upper region of the inward face 138 of the main body 130. The baffles 132 can extend laterally across the inward face 138. The baffles 132 may be shaped as ribs, ridges, and/or fins for example. In some examples, the baffles 132 may correspond to raised strips. The baffles 132 may be elongate or elongated. The baffles 132 can function to divert exhaled air away from the upper portion of the mask 100 and block the exhaled air from fogging the eyewear 104 of the user 102. The baffles 132 can also provide a highly deformable structure that can act in conjunction with the formable seal 134 to create a more effective seal to prevent fogging. A nose bridge clamp 144 may be included in or with the formable seal 134 and may serve to retain a contoured shape of the baffles 132 and/or of the formable seal 134, e.g., further facilitating sealing along the face.

The formable seal 134 can be a member arranged along the upper region of the inward face 138 and can extend laterally across the inward face 138. The formable seal 134 can seal the upper region of the mask 100 to the face of the user 102 and block exhaled air from exiting the mask 100 in proximity to eyewear 104 of the user 102.

The straps 136 can be affixed to the main body 130. The straps 136 can serve to affix the mask 100 to the face of the user 102. For example, the straps 136 may be arrangeable over the ears 114 and/or other portion of the head 110 of the user 102. Adjustment of the straps 136 may control an amount of force holding the mask 100 in place against the face of the wearer 102. Accordingly, the straps 136 may be important to balance comfort and performance.

Having briefly introduced each of the main body 130, baffles 132, formable seal 134, and straps 136 above, additional discussion is included below with respect to collective construction and examples of each particular component as implemented within various embodiments, along with alternative structures and components.

Overall Layers

Figure 3:
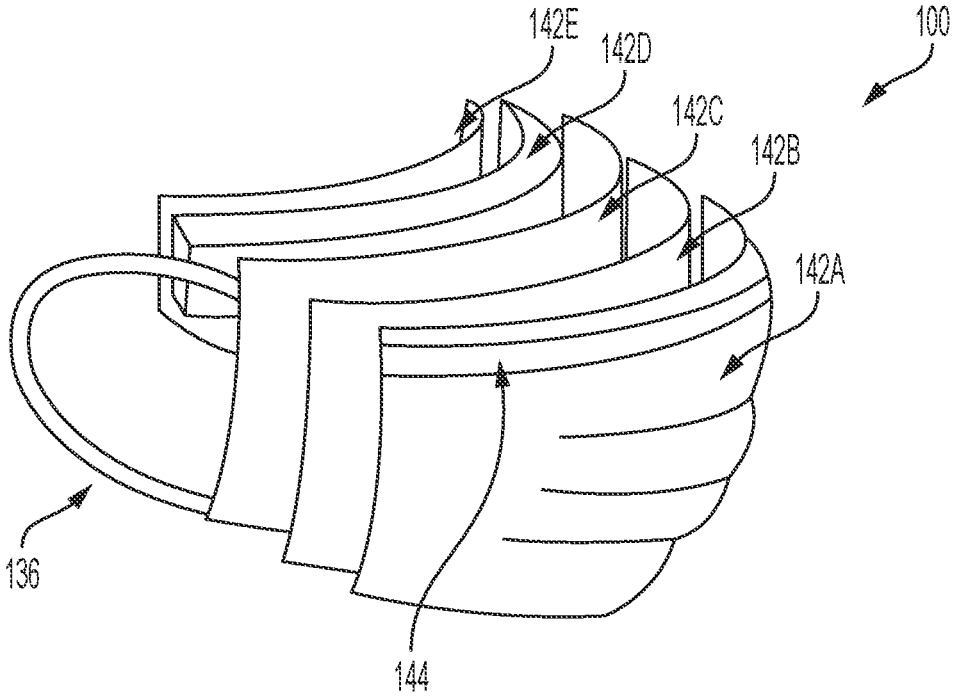
FIG. 3 is a perspective exploded view showing an example of layers that may be utilized to form the mask of FIG. 1, in accordance with various embodiments.

FIG. 3 is a perspective exploded view showing an example of layers 142 that may be utilized to form the mask 100, according to some embodiments. The mask 100 can slow and/or divert a flow path of vapor, e.g., based on the presence of channels or other apertures, baffles or other barriers, and/or other features that may be incorporated into one or more layers 142 used to construct the mask 100. Although any suitable number of layers 142 may be utilized, FIG. 3 shows an example in which the mask 100 is constructed of five layers 142 (individually identified in FIG. 3 as layers 142A, 142B, 142C, 142D, and 142E). Within this example, the first three layers 142A, 142B, and 142C can correspond to the main body 130, while the fourth layer 142D can correspond to the formable seal 134, and the baffles 132 can be incorporated into the fifth layer 142E.

Main Body

The main body 130 can include filtering material of the mask 100. In various examples, the first three layers 142A, 142B, and 142C can include pleated SMS (Spunbond, Meltblown, Spunbond) non-woven medical grade polypropylene fabric. The meltblown layer 142B can be composed of a very dense fiber network and may be used for filtration of particulate, bacteria, and/or fluids. This meltblown layer 142 can be sandwiched between two layers 142A, 142C of spunbond polypropylene fabric. These two outer layers 142A, 142C may correspond to an interior breathable layer 142A forming the inward face 138 and an outer breathable layer 142C forming the outward face 140. The three layers 142A, 142B, and 142C may be thermally bonded to one another along their outer edges.

The main body 130 may be pleated (e.g., as at 127) or folded during manufacture to allow the filtering material to form a curved, bowl-like shape over the mouth and nose. This may increase the surface area for filtration while allowing the material of the mask 100 to be expanded to fit the face of the user 102.

Other options may be utilized in addition to—or in substitution of—the SMS construction. The main body 130 may include one or more layers of paper, cloth, fabric, textile, or other materials that may be suitable for providing filtration. In examples utilizing cloth, the cloth may be constructed of cotton, polyester, other materials, and/or blends thereof. As may be best seen by way of example in FIG. 2, in some embodiments, the main body 130 may include or be coupled with a pocket wall layer 129, e.g., defining a pocket 131 between the pocket wall layer 129 and other portion of the main body 130. The pocket 131 may provide a location for inserting a removable and/or disposable filter media insert, for example. Suitable material may be included in or coupled with the main body 130 based on whether the mask 100 is to be disposable or re-usable, for example.

Baffles

A suitable number of baffles 132 can be arranged along the interior of the main body 130. In FIG. 2, a first baffle 132A, a second baffle 132B, and a third baffle 132C are shown, although a subset, more, fewer, and/or different number of baffles 132 may be utilized (e.g., including but not limited to one, two, three, or more baffles 132). The presence of the baffles 132 may decrease an amount of exhaled air that can reach a position proximal to the eyewear 104 of the user 102. The baffles 132 may function to increase frictional losses in the vapor flow path and/or to create channels that redirect vapor away from the eyewear 104. Additionally or alternatively, the baffles 132 may function to create a restriction in the flow of exhaled air toward the upper portion of the mask 100. The baffles 132 additionally or alternatively function to enhance the seal created by the formable seal 134.

The baffles 132 individually or collectively can be formed by any suitable technique. In some examples, one or more of the baffles 132 are formed as folds or pleats in a sheet 143 of material. The sheet 143 may be part of filtration material or other material used for the main body 130 or may be a separate or distinct layer that is attached with the main body 130. In some examples, one or more of the baffles 132 are formed by addition of secondary components and/or features to the assembly of the mask 100. Such additional or add-on features or components may be made of foam, fabric, or other materials, for example. Examples of suitable materials may include thermoplastic urethanes, thermoplastic elastomers, low durometer materials (including silicones, medical type rubbers, polyester), or other materials suitable for forming baffles 132 of desired shapes and/or functions.

The baffles 132 may have various geometries that generally protrude away from the inward face 138 of the main body 130. One or more of the baffles 132 may extend in a non-perpendicular direction. For example, the baffles 132 may be angled upwards or downwards. Variation in angle utilized for the baffles 132 can impact a degree of "springiness" (e.g., resilience and/or biasing force) that may be exhibited by the baffles 132. Such variation in resilience and/or biasing force may affect the extent of seal obtained against the face of the user 102 when the mask 100 is worn. In addition or as alternatives to changes in baffle angle, variation in resilience and/or biasing force can be altered by implementing changes in length, thickness, and/or material.

Channels

The baffles 132 may define one or more bounds of respective collection reservoirs and/or channels 133. For example, a lower channel 133C may be bounded at least in part by the lower-most baffle 132C. The lower-most baffle 132C may extend downwardly and rearwardly, such as toward the face of the wearer 102 in use. The lower channel 133C may extend from the lower-most baffle 132C and toward and/or underneath a rear and/or underside of the formable seal 134. In use, the lower-most baffle 132C may block vapor from the mouth 124 and/or nostrils 126 and act as an initial barrier against the vapor rising along the face of the wearer 102. Vapor blocked by the lower-most baffle 132C may travel in the lower-most channel 133C along the width or lateral direction of the mask 100 and away from a vertical direction toward the eyewear 104.

A middle channel 133B may be bounded at least in part by the lower-most baffle 132C and the middle baffle 132B. The middle baffle 132B may extend upwardly and rearwardly, such as toward the face of the wearer in use. The middle channel 133B may extend from the lower-most baffle 132C, along a rear of the formable seal 134, and up to the middle baffle 132B, for example. In use, the middle baffle 132B may block vapor that may travel past the lower baffle 132B (such as if the lower-most baffle 132C is temporarily moved out of contact with the face when the wearer 102 is speaking or otherwise causing or permitting movement of the mask 100 relative to the face). Vapor blocked by the middle baffle 132B may travel in the middle channel 133B along the width or lateral direction of the mask 100 and away from a vertical direction toward the eyewear 104.

An upper channel 133A may be bounded at least in part by the middle baffle 132B and the upper baffle 132A. The upper baffle 132A may extend upwardly and rearwardly, such as toward the face of the wearer in use. The upper channel 133A may extend from the middle baffle 132B, along a rear of the formable seal 134, and up to the upper baffle 132A, for example. In use, the upper baffle 132A may block vapor that may travel past the middle baffle 132A (such as if the middle baffle 132B is temporarily moved out of contact with the face when the wearer 102 is speaking or otherwise causing or permitting movement of the mask 100 relative to the face). Vapor blocked by the upper baffle 132A may travel in the upper channel 133A along the width or lateral direction of the mask 100 and away from a vertical direction toward the eyewear 104.

An eyewear channel 133D may be bounded at least in part by the upper baffle 132A. The eyewear channel 133D may extend from the upper baffle 132A and toward and/or over a rear and/or an upper portion of the formable seal 134. For example, opposite the upper baffle 132A, the eyewear channel 133D may be formed at least in part by an angled or other portion of the formable seal 134. The eyewear channel 133D may be V-shaped or otherwise suitably shaped so that the eyewear 104 may be suitably guided to and/or supported in a supported position by the mask 100. In some scenarios, the eyewear 104 may press the upper baffle 132A rearwardly in use. Pressing the upper baffle 132A rearwardly may enhance sealing engagement of the upper baffle 132A with the face of the wearer 102. Additionally or alternatively, pressing the upper baffle 132A rearwardly may alter an angle of the upper baffle 132A, e.g., moving the upper baffle 132A toward an increasingly flattened orientation that may be suitable for further directing any rising vapor away from the lens 106 of the eyewear 104.

The multiple baffles 132 and/or channels 133 may provide redundancy in use. For example, vapor that may circumnavigate a baffle 132 and/or channel 133 at one level, may be blocked and/or re-routed by a baffle 132 and/or channel 133 at a next level upward along the mask 100. Since a movement along the face of the wearer 102 that may permit a temporary deflection or gap along one level may occur at a different time and/or degree than at another level, the multiple vertical levels may be particularly effective at slowing vapor travel and/or permitting time for any escaping vapor to be re-directed laterally. In use, the channels 133 may function as isolation zones. Additionally, or alternatively, the presence of multiple baffles 132 may provide a relatively larger surface area than a single line or interface of contact. Consequently, pressure from securing the mask 100 may be distributed over the relatively larger surface area and provide enhanced comfort in comparison to a single line or interface of contact.

Formable Seal

The formable seal 134 may be created by attaching a deformable structure 146 to the upper portion of the mask 100. The deformable structure 146 may include foam material, for example. The deformable structure 146 may be sufficiently flexible as to be adaptable to the contours of the face of the wearer 102 in response to pressing into place when donning and/or wearing the mask 100. The deformable structure 146 may be sufficiently resilient so as to be capable of substantially maintaining and/or remaining in an adapted or molded shape against the face during use. Molding the formable seal 134 against the face may substantially create a gap-free positioning of the upper portion of the mask 100 against the face.

The formable seal 134 may include or be coupled with a nose bridge clamp 144. Although the nose bridge clamp 144 is shown within the material of the main body 130 in FIG. 2, the nose bridge clamp 144 may be present on top of, between, and/or within any layer of the mask 100. The nose bridge clamp 144 may be formed from a piece of bendable metal. The nose bridge clamp 144 may work in concert with the deformable structure 146 to create the formable seal 134. In some examples, the nose bridge clamp 144 may be capable of holding the deformable structure 146 in a particular shape of being molded against the face of the wearer 102 in use. Baffles 132 and/or other additional ridges, ribs, fins, pleats, or other structures may be added to the deformable structure 146 to enhance the sealing properties of the formable seal 134.

Relevant facial morphology may be considered in a zone between the mask 100 and a nose-to-eye corner of the wearer 102. To fill the gap between the mask borders and the curvature of the face, the deformable structure 146 may be added. The deformable structure 146 in at least one example includes reinforced polyurethane foam, although use may be made of any material with suitable characteristics for intended functions and/or capability.

The deformable structure 146 may be tapered in thickness. Tapering can allow an upper portion of the deformable structure 146 to be thinner than a lower portion of the deformable structure 146. The tapering may result in better line of sight for the wearer 102 in use (e.g., reducing an overall thickness to be looked over along a bottom side of the eyewear 104). Additionally or alternatively, the tapering may create a thicker lower portion of the deformable structure 146, which may enhance blocking against a flow path of exhaled vapor. Additionally or alternatively, the tapering may allow the gap-filling deformable structure 146 to be attached to the mask 100 along a single lengthwise line at an upper region of the inward face 138 of the main body 130 of the mask 100. In turn, a greater zone of focal vision may result (e.g., unobstructed eyesight), especially when looking down while wearing the mask 100 without tilting the head 110. Although FIG. 2 in solid lines shows the tapering occurring solely along an upper portion of the deformable structure 146 and a generally uniform rectangular shape extending below the tapered region, embodiments are not limited to such arrangement. Another example is shown by the dashed line 146A in FIG. 2, which illustrates a taper that extends fully from the bottom to the top of the deformable structure 146. However, the deformable structure 146 may include tapering along any suitable portion of the height of the deformable structure 146.

The deformable structure 146 may improve loading characteristics. For example, incorporating the nose bridge clamp 144 may concentrate a load-bearing area of the deformable structure 146 along the upper region of the mask 100. An anchoring line may be created by the nose bridge clamp 144 along the upper region of the mask 100 and the deformable structure 146. This anchoring of the deformable structure 146 may permit the use of the nose bridge clamp 144 to reduce flexure under cyclic loading and hold the mask 100 tightly to the face. This may prevent the mask 100 from springing out of shape yet still maintain comfort of the wearer 102. The anchoring line created by the nose bridge clamp 144 may allow the deformable structure 146 to expand below the clamp line, e.g., which may improve gap filling. Expansion of the deformable structure 146 below the clamp line may permit the lower edge of the deformable structure 146 to fully expand to block and/or divert exhaled vapors. A thickened bottom edge of the deformable structure 146 may result in the mask 100 coming to rest in a secure location on the face and may prevent inadvertent or unanticipated vertical slippage or movement of the mask 100.

The nose bridge clamp 144 in an illustrative example may be formed from a flat piece of metal (e.g., which may be bar-shaped in lieu of rounded). The piece of metal may be 3 mm (⅛ in) wide, for example. The piece of metal may be 20-gauge in thickness. The characteristics of the nose bridge clamp 144 may provide increased clamp pressure and/or yield strength, e.g., which may hold and conform the mask 100 tightly in place. A flat shape for the wire may prevent the nose bridge clamp 144 from rotating while the wearer 102 presses along the nose 118 to form the seal. Such stability of the nose bridge clamp 144 may combine with the deformable structure 146 to allow the mask 100 to be worn comfortably while preventing a gap from forming when the mask 100 moves. Stability of the nose bridge clamp 144 additionally or alternatively may guard against stretching the mask 100 out of its face-conforming shape when the straps 136 are pulled rearwardly to secure the mask 100 on the head 110 of the wearer 102.

The deformable structure 146 that runs along the upper portion of the mask 100 may be supplemented by the baffles 132 and/or any other ridges, ribs, fins, pleats, or other structure to provide additional sealing effect with the malleable structure. In operation, such additional sealing elements may deform to seal any small gaps that may remain between the deformable structure 146 and the face.

Straps

The straps 136 may securing the mask 100 to the wearer 102. The straps 136 may correspond to ear loops, ties, or any other securing member. An ear loop may include a continuous band that forms a loop that can be hooked over an ear 114 of the wearer 102 to facilitate securing the mask 100. Ties may include individual strands (e.g., tying strands) that may be tied to each other to rest against a rear of the head 110 of the wearer 102. Although ear loops are typically made from an elastic material and ties are typically made from an inelastic material, any elastic or inelastic material may be utilized. Suitable examples may include lycra, spunbond polypropylene, or other materials. Ear loops may have a friction-fit collar (e.g., which may be slidable along the loop to change an amount of the loop that is available for passing around the ear 114), an actuatable clasp, or any other mechanism to adjust the tightness of the mask 100 against the face, while ties may typically be adjusted through the tying action.

The straps 136 may pull the mask 100 into contact (or hold the mask 100 in contact) with the face of the wearer 102. For example, in particular, the straps 136 may pull the deformable structure 146 into contact with the face. In effect, the straps 136 may establish and/or increase the contact force of the seal against the face of the wearer 102.

Example Construction

The mask 100 may be produced by any suitable fabrication method. Any order of combination of components may be utilized. In some embodiments, the main body 130 may be provided. Provision of the main body 130 may include providing the main body 130 with multiple layers (e.g., layers 142A, 142B, and 142C having an SMS construction). The main body 130 may be provided partially or wholly assembled or unassembled. The main body 130 may be provided with a nose bridge clamp 144 (such as within or over other layers 142), or the nose bridge clamp 144 can be added to the main body 130 before, during, or after addition of other components. Similarly, straps 136 may be attached to the main body 130 before, during, or after addition of other components.

For the arrangement in FIG. 2, the deformable structure 146 may be placed along an upper region of the main body 130. The sheet 143 used for forming pleats to provide the baffles 132 may be laid over the deformable structure 146. An upper end 148 of the sheet 143 may be tucked between the deformable structure 146 and the main body 130. A lower end 150 of the sheet 143 may be arranged along an underside of the deformable structure 146. A first stitching 152 may extend through the main body 130, the deformable structure 146, and the sheet 143. For example, the first stitching 152 may extend through two portions of the sheet 143 (e.g., a portion overlaying the deformable structure 146 and another portion tucked between the main body 130 and the deformable structure 146). The first stitching 152 may compress the deformable structure 146. For example, by providing compression, the first stitching 152 may impart at least part of a tapered shape of the deformable structure 146.

A second stitching 154 may extend through the main body 130 and the sheet 143. The second stitching 154 may secure the main body 130 with the sheet 143 such that the deformable structure 146 is securely captured or contained between the sheet 143 and the main body 130. The second stitching 154 may secure the main body 130 and the sheet 143 without passing through the deformable structure 146. Thus, the deformable structure 146 may be stitched at an upper region and free floating along a bottom region. Avoiding the deformable structure 146 with the second stitching 154 may allow a lower portion of the deformable structure 146 to remain at a larger size than at an upper portion of the deformable structure 146 and contribute to the tapered shape of the deformable structure 146.

Although the above method has been described for constructing the mask 100, the mask 100 is not limited to such features or operations and can be fabricated by any other suitable approach. For example, stitching may be different than shown or described (or absent) and/or respective features may be formed from other elements in addition to or as alternatives. It is also possible to fix the deformable structure 146 to the mask 100 by non-stitched methods, such as adhesive or heat sealing. As further examples, respective features may be constructed from extruded parts or otherwise formed by any suitable technique and are not limited to fabrication by use of substrates or other particular structures.

Findings:

During development, various considerations were evaluated.

With respect to foam cushioning (e.g., in the deformable structure 146), using a foam cushion with increased thickness can be detrimental beyond a certain point. If the cushion is too thick, a downward decrease in visibility may be encountered. As an alternative or additional consideration, if the cushion is too thick, it can become difficult to shape the mask 100 to the face of the wearer 102, e.g., especially around the tip of the nose 118. As a further alternative or additional consideration, a thicker cushion may be accompanied by a thicker gauge wire (e.g., in the nose bridge clamp 144) in order to create adequate clamping pressure of the cushion to the face. For example, if the wire is not thick enough, then the wire may lack adequate resiliency or force-application to retain the cushion in a bent configuration formed to the shape of the face. The cushion in use may be in a suitable middle ground of being thick enough to provide comfort and fog blocking, while also not being so thick as to become unwieldy. In various trials, one example of a suitable thickness of the foam cushion of the deformable structure 146 was approximately ¼ inch (6.35 mm) at a lower end.

With respect to clamping wire (such as in the nose bridge clamp 144), generally an increase in thickness of the wire can lead to a decrease in comfort of the mask 100. Wire thickness may be directly related to ability of the wire to clamp tightly to the face and/or hold a shape and/or position. While using a thicker wire may (i) facilitate holding the mask 100 in place tightly along the face and (ii) resist bending of the wire toward a straightened shape from pulling on the straps 136, using a thicker wire may also result in a mask 100 that is not very comfortable. In contrast however, a thinner wire may be unable to maintain suitable clamping pressure. Thus, the wire in use may be in a suitable middle ground in thickness (e.g., not too tight and not too flimsy). In various trials, one example of a suitable thickness and/or size of the wire of the nose bridge clamp 144 was a strip of aluminum 3 approximately mm wide and between 20 and 24 gauge in thickness for disposable masks. In various trials, when greater effective life or durability was sought for use in reusable cloth masks, an example of a 5/32 (4 mm) width double wire plastic clamp with wire gauge 24 had slightly lower performance but worked well.

Figure 4A:
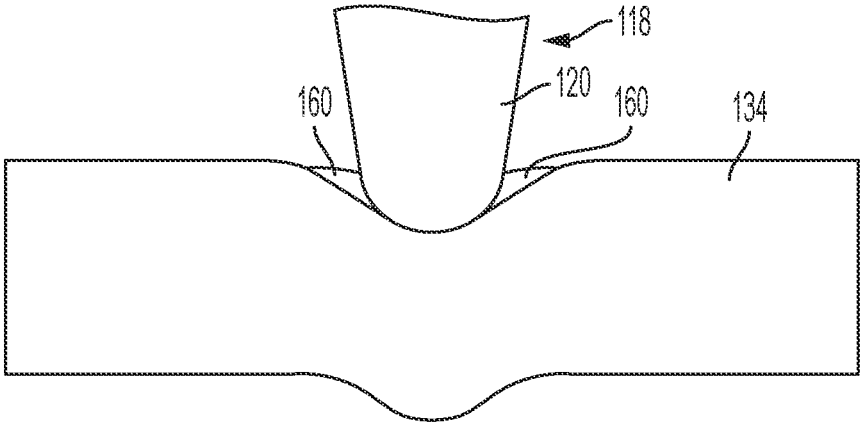
FIGS. 4A and 4B are top views showing examples of fit along a bridge of a nose of a wearer, in accordance with various embodiments.
Figure 4B:
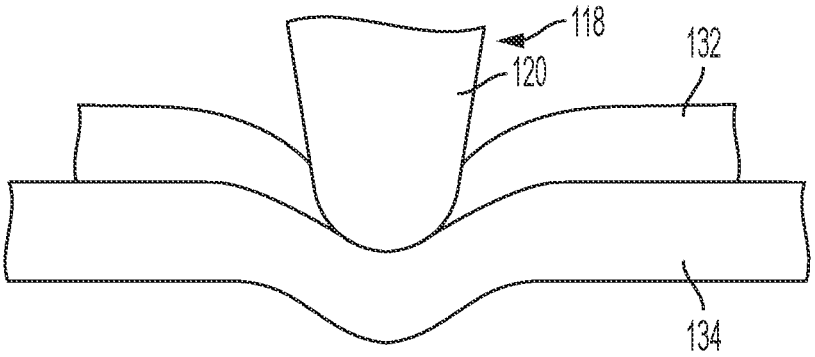

With respect to baffles (e.g., baffles 132), using pleats as baffles that can deform upwards and downwards at relevant angles can facilitate increased gap filling. Such gap filling may be particularly relevant with use of a relatively thinner cushion. Reference may be made to FIGS. 4A and 4B.

FIGS. 4A and 4B each show top views in which abridge 120 of a nose 118 is visible. FIG. 4B shows a a baffle 132 and a relatively thinner formable seal 134, while in contrast, FIG. 4A shows a relatively thicker formable seal 134 unaccompanied by any baffle 132. As may be seen in FIG. 4A, gaps 160 may form along a formable seal 134 and adjacent the bridge 120 of the nose 118 in the absence of a baffle 132. Such gaps 160 may provide passages for vapor travel that can lead to fogging of eyewear 104, for example. In some instances, such gaps 160 may be a result of a thicker formable seal 134 resisting suitable bending for forming a curvature to match the profile of the face (e.g., on account of the thickness of the formable seal 134, for example). In contrast, as may be seen in FIG. 4B, the presence of a baffle 132 may enhance the seal of the formable seal 134 along the face of the wearer 102. For example, the baffle 132 may be capable of deforming to fill and/or seal against gaps 160 around the nose 118 of the wearer 102.

Also with respect to baffles (e.g., baffles 132), length can be a relevant factor. Referring again to FIG. 2, a baffle length 162 may be the distance that the baffle 132 protrudes from the mask 100 towards the face. Various examples utilize a baffle length 162 of approximately 3/16 inches (4.8 mm). Tested designs using longer baffles 132 did not prove to be beneficial. In various examples where the baffle length 162 was longer, the baffles 132 exhibited a floppy characteristic and did not hold shape as fully. Additionally, in cases where the baffle length 162 is too long, the baffle 132 can begin to poke into lower eyelids of the wearer 102 and contribute to discomfort. Accordingly, in various examples, the baffle length 162 of approximately 3/16 (4.8 mm) was implemented as a suitable optimal length. However, other values for the baffle length 162 may be implemented, such as based on an angle of the corresponding baffle 132.

Also with respect to baffles (e.g., baffles 132), thickness can be a relevant factor. Referring again to FIG. 2, a baffle thickness 164 may be the distance that the baffle 132 extends in cross-section. In some examples, the baffle thickness 164 may be measured as a maximum thickness, a thickness at a median point, an average thickness, or other relevant measure of overall or particularized thickness of the baffle 132. As the baffles 132 deform to create a facial seal, the baffle thickness 164 can have an impact in the force and/or deflection characteristics of the baffle 132 as the mask 100 is fitted to the face. Relatively larger baffle thickness 164 may resist larger levels of force before deforming and may quickly become uncomfortable. In addition, reduced flexibility from an increased baffle thickness 164 may decrease formability for sealing against the face. Accordingly, in various examples, the baffle thickness 164 of ranging between 0.005 inches (0.127 mm) and 0.008 inches (0.203 mm) was implemented as a suitable optimal thickness (e.g., varying based on whether measured at a base or a midpoint of the baffle 132). However, other values for the baffle thickness 164 may be implemented, such as depending on the characteristics of the material used and/or the baffle length 162.

Also with respect to baffles (e.g., baffles 132), number of baffles 132 can be a relevant factor. In various trials, zero, one, two, and three baffles 132 were tested respectively. Specifically, trials tested zero, one, two, and three pleats quantitatively by comparing fogging at 65° C. using a testing device that measures humidity around the eyewear 104 and running multiple trial runs with people of different face shapes. Three baffles 132 were the most effective in the trials. For the tested one-baffle mask, the baffle location was a top vertical baffle. For the tested three-baffle masks, the baffle locations included two baffles 132 facing upward and one baffle 132 facing downward, consistent with the arrangement shown in FIG. 2.

Figure 5:
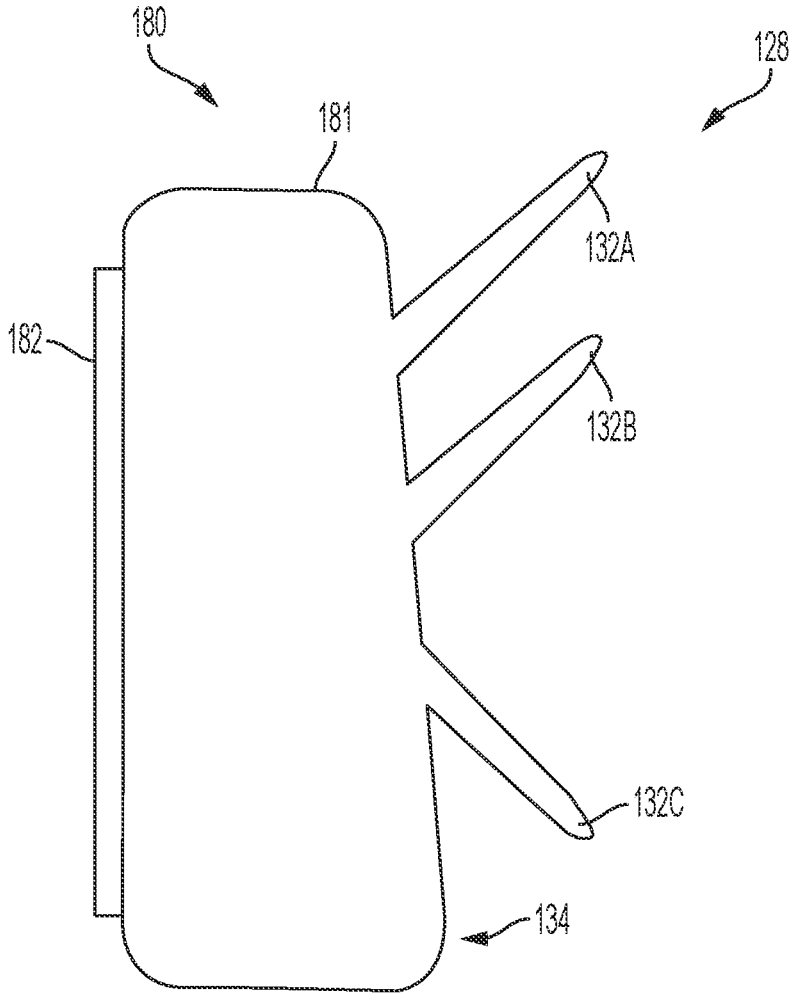
FIG. 5 is a side view of an example of a sub-assembly that may form a portion of the mask of FIG. 1, in accordance with various embodiments.

FIG. 5 shows an example of a sub-assembly 180 that may form a portion of the mask 100. In some examples, the sub-assembly 180 may be provided as a subcomponent for inclusion in the mask 100. For example, the sub-assembly 180 may be provided as a part to be included during initial fabrication of the mask 100, or the sub-assembly 180 may be provided as a part that can be added as a retrofit option for an existing mask 100. The sub-assembly 180 may include features of the anti-fogging system 128.

The sub-assembly 180 may include a base 181. The base 181 may include a body, core, or other foundational component relative to which other components are arranged, or in which other components are included.

The sub-assembly 180 may include the formable seal 134 and one or more baffles 132. The formable seal 134 may be included and/or form part of the base 181. The baffles 132 may extend from the base 181. The baffles 132 are shown with a lower-most baffle 132C oriented extending downwardly, while a middle baffle 132B and upper-most baffle 132A are each shown oriented extending upwardly, although other geometries and/or orientations are possible, such as described previously.

The sub-assembly 180 may include an attachment interface 182. Although shown as an adhesive patch in FIG. 5, the attachment interface 182 may correspond to any other suitable structure or interface for facilitating attachment, including, but not limited to hot-melt material, stitching, a stitchable panel, other sewable structure, other sewn structure, hook and loop fasteners, or other fastening mechanisms. In use, the attachment interface 182 may facilitate attachment of the sub-assembly 180 with a main body 130 to form the mask 100.

In some examples, the sub-assembly 180 may be formed of assorted layers, e.g., similar to layers 142D and 142E described above. However, the sub-assembly 180 is not so limited, and can be any composite or monolithic structure. The sub-assembly 180 may include components constructed from foam, fabric, or other materials, for example. Examples of suitable materials may include thermoplastic urethanes, thermoplastic elastomers, low durometer materials (including silicones, medical type rubbers, polyester), or other materials suitable for forming baffles 132 of desired shapes and/or functions.

Figure 6A:
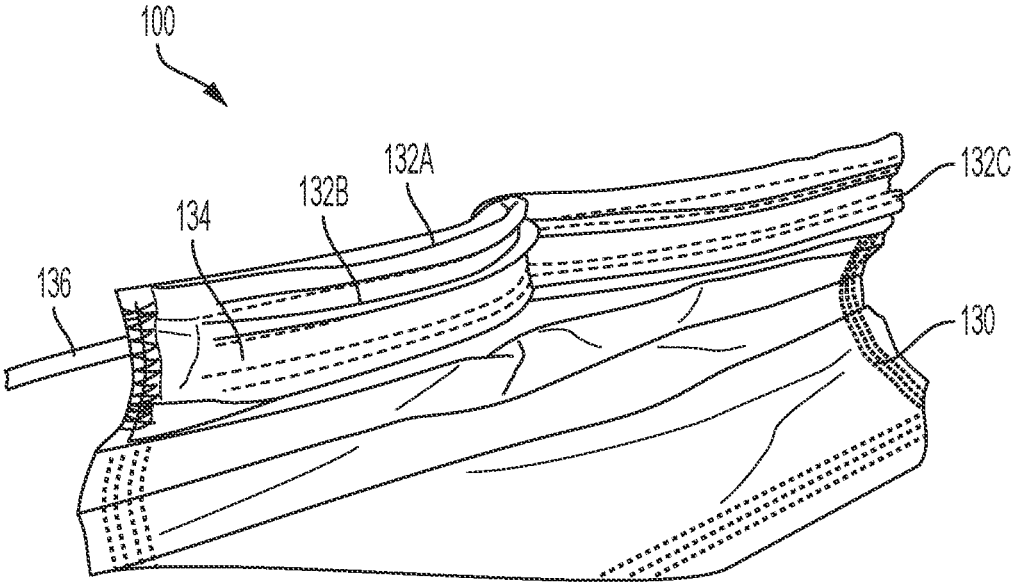
FIGS. 6A and 6B show perspective views of examples of the mask of FIG. 1, in accordance with various embodiments.
Figure 6B:
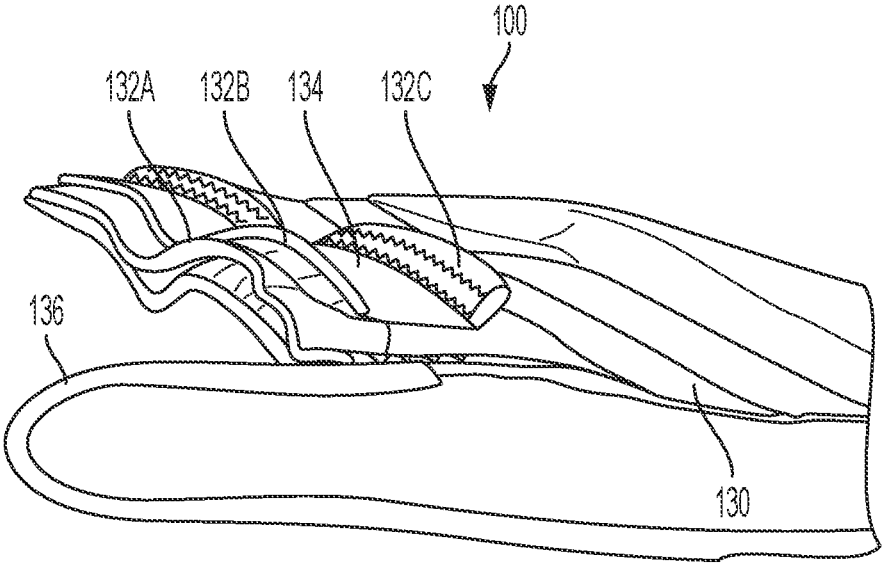

FIGS. 6A and 6B show perspective views of examples of the mask 100 fabricated for testing and proof of concept. Examples of the baffles 132 and the formable seal 134 are shown relative to the main body 130 and straps 136. Although the images are representative of single-use or otherwise disposable masks, similar features may be implemented in re-usable masks (e.g., which may include cloth or other forms of durable and/or washable material).

Figure 7A:
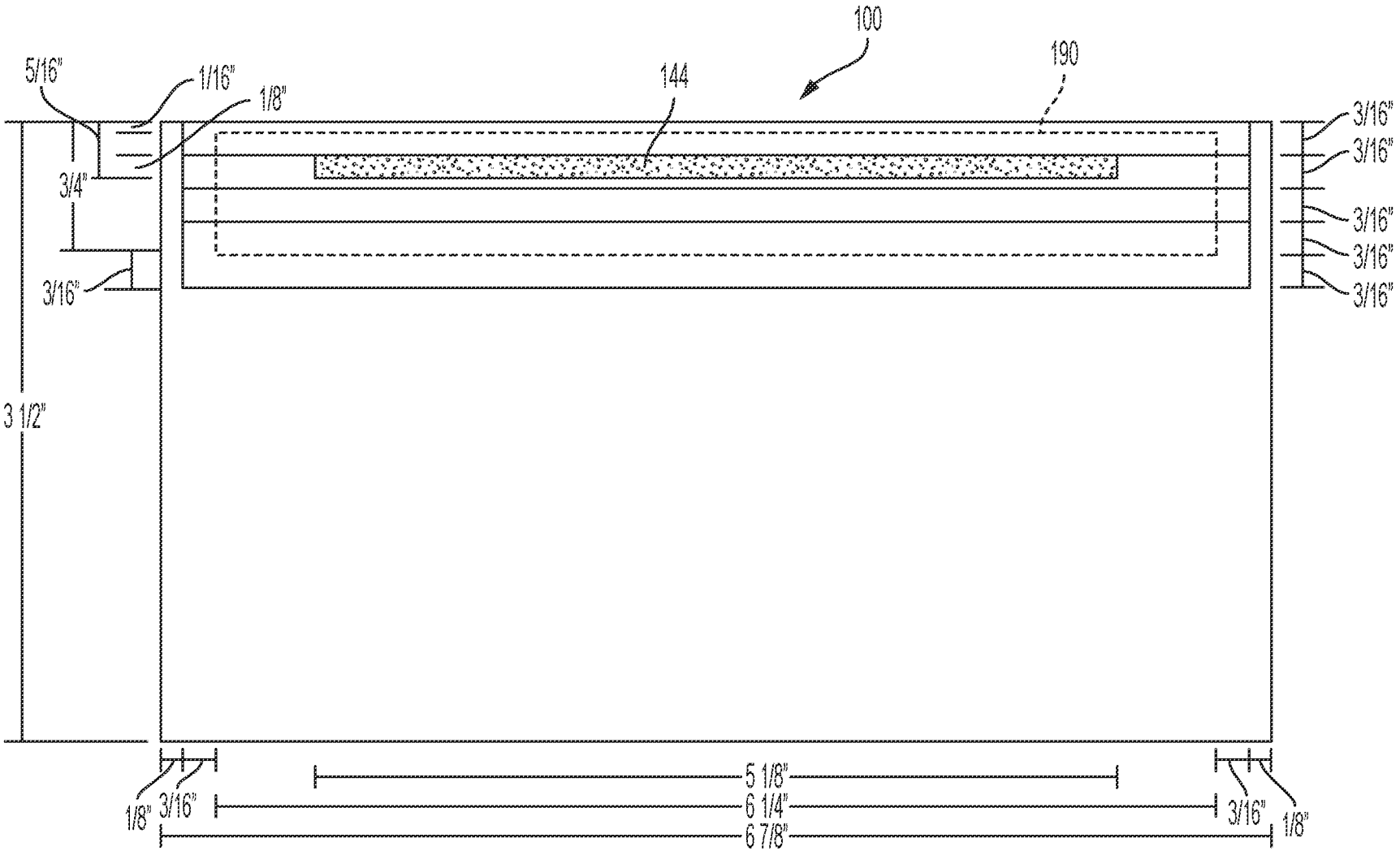
FIGS. 7A and 7B are respectively front and side dimensioned views of the example of the mask shown in FIGS. 6A and 6B, in accordance with various embodiments.
Figure 7B:
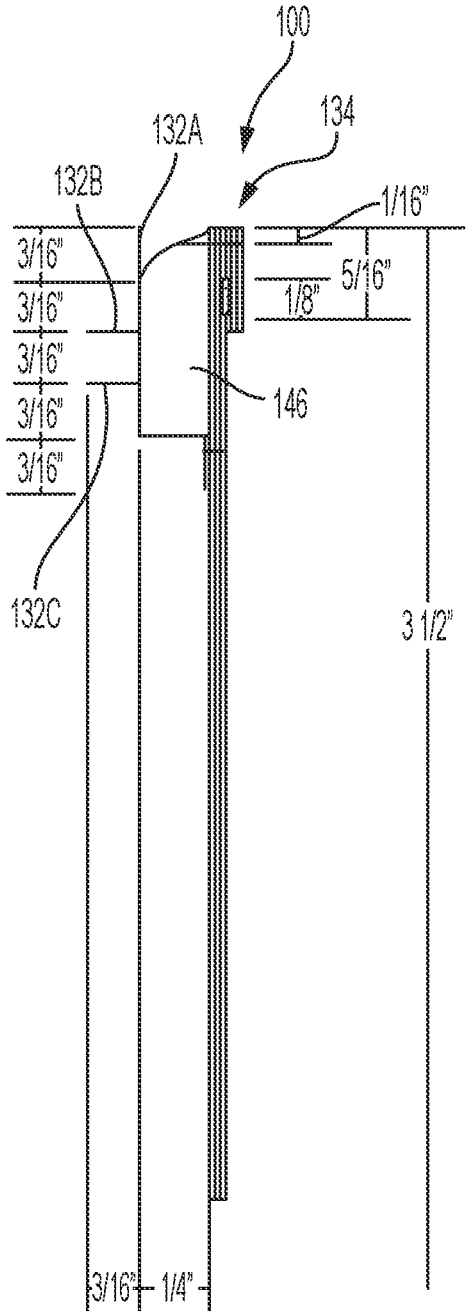

FIGS. 7A and 7B are respectively front and side dimensioned views of the example of the mask 100 shown in FIGS. 6A and 6B. FIGS. 7A and 7B show dimensions of different elements that were utilized in this example. For example, the baffles 132 may be spaced apart from one another at approximately 3/16 or 0.19 inches (4.76 mm) apart as shown, or may be spaced apart at 0.25 inches (6.35 mm) or other value. As a further example dimension, the baffles 132 may each extend each extend approximately 3/16 or 0.19 inches (4.76 mm) in length or another length may be used. FIG. 7A shows a stitching outline 190 by which the deformable structure 146 of the formable seal 134 is connected with the main body 130, although other forms of attachment may be utilized. In FIG. 7B, the baffles 132A, 132B, and 132C are shown substantially at right angles relative to other features of the mask 100. This may correspond to the baffles 132A having been moved into such position for ease of viewing dimensions, for example. However, the baffles 132 may be biased at, at rest at, and/or otherwise arranged or oriented at these or other angles in use, such as when in contact against the face or at rest in a non-donned state.

Other variations are within the spirit of the present invention. Thus, while the invention is susceptible to various modifications and alternative constructions, certain illustrated embodiments thereof are shown in the drawings and have been described above in detail. It should be understood, however, that there is no intention to limit the invention to the specific form or forms disclosed, but on the contrary, the intention is to cover all modifications, alternative constructions, and equivalents falling within the spirit and scope of the invention, as defined in the appended claims.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. The term "connected" is to be construed as partly or wholly contained within, attached to, or joined together, even if there is something intervening. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate embodiments of the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

All references, including publications, patent applications, and patents, cited herein are hereby incorporated by reference to the same extent as if each reference were individually and specifically indicated to be incorporated by reference and were set forth in its entirety herein.

What is claimed is:

1. An anti-fogging face mask, the face mask comprising:

a main body comprising a panel sized to cover a mouth and nostrils of a wearer, the main body having a front side facing in a forward direction extending away from the wearer in use, the main body further defining a rear side facing in a rearward direction extending toward the wearer in use;

a formable seal member disposed along an upper portion of the main body, the formable seal comprising a front face facing the main body, the formable seal further comprising a rear face facing away from the main body, the formable seal comprising a foam material shaped to include a tapered upper edge that tapers upwardly and in a direction extending from the rear face toward the front face;

a first pleat defining a first baffle extending upwardly and rearwardly from the rear face of the formable seal at least prior to donning the mask so as to define an eyewear-receiving channel between the first baffle and the tapered upper edge of the formable seal;

a second pleat defining a second baffle extending upwardly from the rear face of the formable seal from a position below the first pleat at least prior to donning the mask; and a third pleat defining a third baffle extending downwardly from the rear face of the formable seal from a position below the first pleat at least prior to donning the mask;

wherein a lower channel is defined beneath the third pleat, a middle channel is defined between the third pleat and the second pleat, and an upper channel is defined between the second pleat and the first pleat, wherein the first pleat, the second pleat, the third pleat, the lower channel, the middle channel, and the upper channel are configured for blocking or re-directing travel of exhaled vapor away from eyewear in the eyewear-receiving channel so as to mitigate against fogging of the eyewear in use.

2. The face mask of claim 1, wherein the first pleat, the second pleat, and the third pleat are formed in a sheet of polypropylene material overlaying the formable seal member and attached to the main body, wherein the main body comprises an outerwardly-facing layer of spunbond polypropylene, a middle meltblown layer of polypropylene, and an inwardly-facing layer of spunbond polypropylene.

3. The face mask of claim 2, wherein the first pleat, the second pleat, and the third pleat are spaced apart from one another at approximately 0.19 inches (4.76 mm) apart, and wherein the first pleat, the second pleat, and the third pleat each extend approximately 0.19 inches (4.75 mm) in length.

4. An anti-fogging face mask, the face mask comprising:

a main body comprising a panel sized for coverage of mouth and nostrils in a donned position of the face mask;

a formable seal member disposed along an upper portion of the main body and arranged for obstructing vapor flow from the mouth or nostrils to eyewear when the eyewear is positioned over the face mask in the donned position, wherein the formable seal member is shaped with a taper that tapers upwardly such that an upper portion of the formable seal member is narrower than a lower portion of the formable seal member;

stitching extending through the upper portion of the formable seal member, the stitching connecting the formable seal member with the main body, the stitching further compressing the upper portion of the formable seal member to impart at least part of a tapered shape of the formable seal member;

a first baffle extending rearwardly and upwardly away from the formable seal at least prior to donning the mask;

a second baffle positioned below the first baffle and extending rearwardly and upwardly away from the formable seal at least prior to donning the mask; and a third baffle positioned below the second baffle and extending rearwardly and downwardly away from the formable seal at least prior to donning the mask.

5. The face mask of claim 4, wherein the first baffle, the second baffle, and the third baffle are formed as folds or pleats in a sheet of material attached with the main body.

6. The face mask of claim 5, wherein the sheet of material comprises polypropylene, and wherein the main body comprises multiple polypropylene layers that include a melt-blown layer sandwiched between spunbond layers.

7. The face mask of claim 4, wherein the formable seal member comprises a foam material.

8. The face mask of claim 4, further comprising straps coupled with the main body, the straps comprising tying strands or ear loops.

9. The face mask of claim 4, further comprising a nose bridge clamp operable to be pressed into a shape for conforming the formable seal toward a shape of a face of a wearer in the donned position.

10. The face mask of claim 9, wherein the nose bridge clamp comprises metal of at least 20 gauge and no greater than 25 gauge.

11. The face mask of claim 4, wherein the face mask is configured to be disposable or re-usable.

12. An anti-fogging assembly for a face mask, the assembly comprising:

a base comprising a formable seal member;

a first baffle extending rearwardly and upwardly from the base at least prior to donning the mask;

a second baffle positioned below the first baffle and extending rearwardly from the base at least prior to donning the mask;

a third baffle positioned below the second baffle and extending rearwardly and downwardly from the base at least prior to donning the mask, wherein at least one of the first baffle, the second baffle, or the third baffle is formed as a pleat of a sheet of material; and an attachment interface configured for facilitating attachment of the base with a main body of a face mask in a position for blocking upward vapor travel in a donned state.

13. The assembly of claim 12, wherein the attachment interface comprises a surface configured for abutting the main body of the face mask for attachment via an adhesive, stitching, or bonding.

14. The assembly of claim 12, wherein the first baffle, the second baffle, and the third baffle are each elongate.

15. The assembly of claim 12, wherein the formable seal member is shaped with a taper that tapers upwardly such that an upper portion of the formable seal member is narrower than a lower portion of the formable seal member; and wherein the assembly further comprises stitching extending through the upper portion of the formable seal member, the stitching further compressing the upper portion of the formable seal member to impart at least part of a tapered shape of the formable seal member.

16. The assembly of claim 12, further comprising the main body of the face mask.

17. The assembly of claim 16, wherein the formable seal member is shaped with a taper that tapers upwardly such that an upper portion of the formable seal member is narrower than a lower portion of the formable seal member; and wherein the assembly further comprises stitching extending through the upper portion of the formable seal member, the stitching connecting the formable seal member with the main body, the stitching further compressing the upper portion of the formable seal member to impart at least part of a tapered shape of the formable seal member.

* * * * *